United States Patent [19]

Matsubara

[11] 3,990,361

[45] Nov. 9, 1976

[54] TYPEWRITING DEVICE

[75] Inventor: Toru Matsubara, Chofu, Japan

[73] Assignee: Tokyo Juki Kogyo Kabushiki Kaisha, Tokyo, Japan

[22] Filed: Mar. 7, 1975

[21] Appl. No.: 556,412

[30] Foreign Application Priority Data

Mar. 8, 1974 Japan ..... 49-27461

[52] U.S. Cl. ..... 101/93.23; 101/93.09

[51] Int. Cl.[2] ..... B41J 1/32

[58] Field of Search ..... 101/93.04, 93.05, 93.11, 101/93.09, 93.13, 93.18, 93.23, 110, 93.28; 197/49, 1 R; 178/28, 30, 33, 34, 32

[56] References Cited

UNITED STATES PATENTS

| | | | |
|---|---|---|---|
| 3,128,693 | 4/1964 | Thiemann | 101/93.09 |
| 3,220,343 | 11/1965 | Wasserman | 101/93.09 |
| 3,630,335 | 12/1971 | Chamness | 101/93.09 |
| 3,850,097 | 11/1974 | Sweeney | 101/93.09 |

*Primary Examiner*—Ralph T. Rader
*Attorney, Agent, or Firm*—Wenderoth, Lind & Ponack

[57] ABSTRACT

A typewriting device has a type-carrying drum including a plurality of cylinders arranged in end-to-end relationship on the axis of the drum and each carrying a plurality of type elements arranged in spirals. A typewriting paper positioned adjacent to the drum is intermittently fed by feed means for intermittently feeding the paper tangent to the drum. A plurality of hammer members are positioned opposite to the cylinders of the drum for moving toward and away from the drum, the space between the hammers being the same as that between the spirally positioned type elements, and drive means for rotating and axially moving the type-carrying drum, whereby each time each type element passes by its associated hammer member, the hammer member is actuated to effect one typewriting operation on the paper and thereafter, the typewritten paper is intermittently fed.

5 Claims, 4 Drawing Figures

TYPEWRITING DEVICE

BACKGROUND OF THE INVENTION

This invention relates to a line printer-type typewriting device and more particularly, to a line printer-type typewriting device which comprises a relatively small diameter type-carrying drum to thereby ensure smooth mechanical movement of the drum and improve the service life of the drum.

There have been proposed and practically employed a great variety of line printer-type typewriting devices and the conventional typewriting devices are generally divided into two classes, that is, the so-called type-carrying drum type typewriting device and the so-called chain or belt-type typewriting device. In the former type the drum carries a plurality of type elements which bear letters of the alphabet, Kana (characters of Japanese alphabets), numerals and other symbols, for example, on the periphery of the drum intersecting the axis of the drum at right angles thereto. However, the drum employed in this type of typewriting device generally has a large diameter which results in a bulky and expensive typewriting device. Although the latter type, that is, the chain or belt type device, can be reduced in size as compared with the former type, since the chain or belt is generally driven at a high speed, fatigue frequently appears at the joints between adjacent links in the chain or adjacent webs in the belt and thus, the chain or belt-type device has the disadvantages that the device easily gets out of order and has a relatively short service life.

SUMMARY OF THE INVENTION

Therefore, this invention seeks to provide a novel and improved typewriting device which can effectively eliminate the disadvantages inherent in the prior art typewriting devices described to above.

In the novel and improved typewriting device of the present invention, the disadvantages are overcome by incorporating both the conception of the prior art drum type device in which the type is arranged in lines transverse to the axis of the drum and that of the chain or belt type device in which the type is arranged in lines parallel to the axis of the drum.

According to the present invention, there is provided a typewriting device which comprises in combination a type-carrying drum includng a plurality of type-carrying cylinders arranged in end-to-end relationship on the axis of said drum and each carrying the same number of type elements thereon in equally spaced spirals, a typewriting paper disposed adjacent to said drum, feed means for intermittently feeding said paper on a path tangent to the drum, a plurality of hammer members disposed opposite to the respectively associated cylinders of the drum in the same spaced relationship as said spirals of type elements for moving toward and away from the associated cylinders and drive means for rotating and moving axially said type-carrying drum, whereby each time each type elements passes by its associated hammer member, the hammer member is operated to effect a typewriting operation and thereafter, said paper is intermittently fed.

The above and other objects and attendant advantages of the present invention will be more readily apparent to those skilled in the art from a reading of the following detailed description in conjunction with the accompanying drawings which show one preferred embodiment of the invention for illustration purpose only, but not for limiting the scope of the same in any way.

PREFERRED EMBODIMENT OF THE INVENTION

Figure 1:
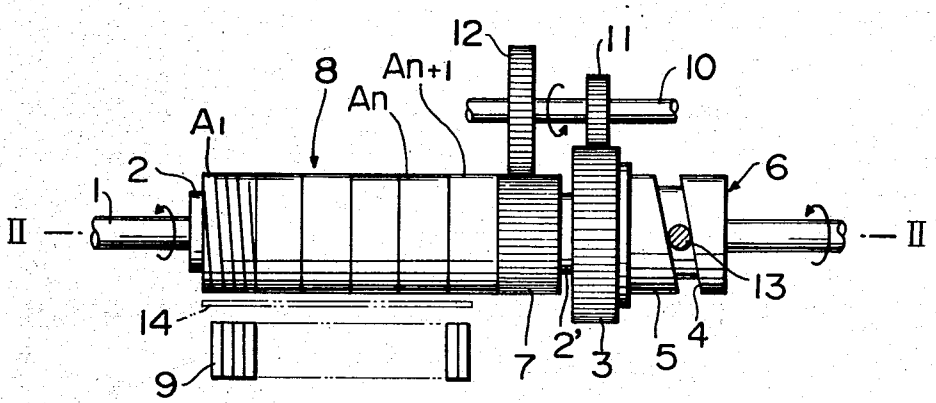
FIG. 1 is a front elevational view of one preferred embodiment of a typewriting device constructed in accordance with the present invention with a portion thereof cut away.
Figure 2:
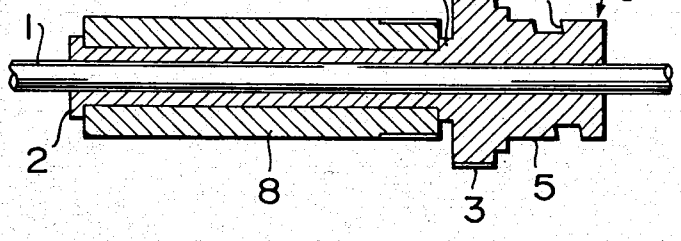
FIG. 2 is a longitudinal sectional view of said device as shown in FIG. with some parts shown in FIG. 1 cut away.

The present invention will now be described referring to the accompanying drawings which show one preferred embodiment of the typewriting device of the invention. A horizontal shaft 1 is fixedly secured to the framework (not shown) of the typewriting device and an integral operating member 6 is mounted on the shaft for rotational movement about the axis of the shaft and also for sliding movement along the length of the shaft 1. The operating member 6 integrally includes a reduced diameter portion having a substantial length and defined at the opposite ends by enlarged diameter end portions 2 and 2', a spur gear 3 and a cam portion 5 having a peripheral groove 4 in the outer surface thereof. A type-carrying drum 8 is freely rotatably mounted on the reduced diameter portion of the operating member 6 between the enlarged end portions 2 and 2' and the drum has formed at one end portion or the right-hand end portion as seen in FIG. 1 a spur gear 7. The type-carrying drum 8 is allowed to rotate about the axis of the operating member 6, but is prevented from moving along the length of the opeating member. The rest of the type-carrying drum 8 is divided into a plurality of equal sections so as to form a plurality of cylinders A and each of the cylinders A carries on its periphery a desired number of type elements. In the illustrated embodiment, one hundred and twenty type elements bearing lettes of the alphabet, Kana (characters of Japanese alphabets), numerals and other symbols are arranged in series in four equally spaced spirals on each cylinder A. In the illustrated embodiment, the number of the cylinders A having the above-mentioned type elements in the spiral arrangement on the periphery corresponds to a required number of cylinders $n$ plus one cylinder A, that is, $n + 1$ cylinders. A second shaft (not shown) fixedly secured to the framework (not shown) of the typewriting device has plural groups of hammer levers 9 which cooperate with the associated cylinders A of the drum 8 and each group comprises four hammer levers 9 arranged at the same pitch as that of the spirals of the type elements on the type-carrying drum 8. The total number of hammer levers 9 is the number $n$ of type-carrying cylinders A times the number of hammer levers 9 associated with each cylinder A, that is, $4n$. The hammer levers 9 are normally held away from the outer periphery of the type-carrying drum 8. For driving the hammer levers 9 so as to cause the levers to strike against the respectively associated types in the spirals to thereby effect a cycle of a typewriting operation, there are provided electromagnets (not shown) in association with the hammer levers 9 in opposition thereto. Thus, when a selected electromagnet is energized, the hammer lever associated with the energized electromagnet 9 is rotated about the above-mentioned second shaft (not shown) to strike against one of the types in the associated spiral to thereby effect one typewriting operation.

A third shaft 10 is provided adjacent to the operating member 6 parallel to the first shaft 1 and interlocked with a drive source (not shown) to be rotated thereby. The shaft 10 has spur gears 11 and 12 meshing with the associated spur gears 3 and 7 on the operating member 6 and type-carrying drum 8, respectively. The lengths, or face widths, of the spur gears 3 and 7 in the axial direction of the associated shaft 1 is greater than that of the cylinders A in the same direction.

Numeral 13 denotes a pin which has one end fixedly secured to the framework (not shown) of the typewriting device and the other end freely received in the cam groove 4 in the cam portion 5 and numeral 14 denotes a typewriting paper disposed between the type-carrying drum 8 and the hammer levers 9 to be intermittently fed along a path between the drum 8 and hammer levers 9 which path is tangent to the type-carrying drum 8.

Figure 3:
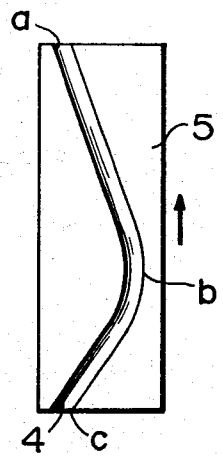
FIG. 3 is a developed view on an enlarged scale of the cam groove as shown in FIG. 1.
Figure 4:
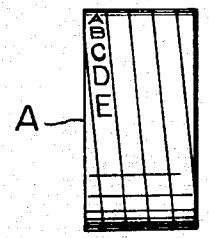
FIG. 4 is an elevational view on an enlarged scale of the type carrying drum as shown in FIG. 1.

When the shaft 10 is rotated, the spur gears 11 and 12 on the shaft 10 rotate in the same direction which in turn rotate the spur gears 3 and 7 which are meshing with the spur gears 11 and 12, respectively. The rotation of the spur gears 3 and 7 rotate the operating member 6 and type-carrying drum 8 in the direction of the arrow. The relationsip between the number of rotations of the operating member 6 and type-carrying drum 8 per unit time and the pin 13 and the cam groove 4 in the operating member 6 is so selected that as the type-carrying drum 8 makes N complete rotations, the operating member 6 makes one rotation. For example, in the illustrated embodiment, as the type-carrying drum 8 makes six rotations, the operation member 6 rotates one rotation. Therefore, as the type-carrying drum 8 makes four complete rotations, the cam portion 5 integral with the operation member 6 rotates through the angular distance corresponding to the section from the position *a* to the position *b* as shown in FIG. 3. At this time, the operating member 6 and type-carrying drum 8 are moved leftward (as seen in FIG. 1) a distance corresponding to the width of one cylinder A of the type-carrying drum 8 by means of the cam groove 4 in which the pin 13 having one end fixedly secured to the framework is freely received and thereafter, as the drum 8 makes two further complete rotations, the cam portion 5 rotates through the angular distance corresponding to the section from the position *b* to the position of *c*. In this way, by virtue the configuration the section *b* – *c* of the cam groove 4, the operating member 6 and type-carrying drum 8 move rightward as seen in FIG. 1 a distance corresponding to one of the cylinders A of the drum 8 to the initial position prior to the typewriting operation to thereby complete one cycle of operation.

The twist angle of the section *a* – *b* of the cam portion 5 is so selected that as the type-carrying drum 8 makes one complete rotation, the drum 8 moves leftward as seen in FIG. 1 a distance corresponding to one of the four spirals on each cylinder A. As the type-carrying drum 8 moves leftward as seen in FIG. 1 a distance corresponding to four spirals or one type-carrying cylinder A while rotatating about the axis of the shaft 1, all the type elements in the spirals pass by the associated hammer levers 9 once.

With the above construction and arrangement of the parts of the typewriting device of the invention, when the leftmost one of the hammer levers is positioned opposite the first one of a series of type elements in the leftmost spiral of the leftmost cylinder A of the type-carrying drum 8, the leftmost one of each four hammer levers 9 associated with each of the type-carrying cylinders A is also positioned opposite to the first one of a series of type elements in spirals on the succeeding type-carrying cylinders A. Under the above-mentioned conditions, when the drive source (not shown) is energized to rotate the third shaft 10 and accordingly, the spur gears 11 and 12 thereon, the type-carrying drum 8 is rotated in the direction of the arrow through the spur gear 7 which is in mesh with the gear 12. As the drum 8 makes four complete rotations in the direction of the arrow, the operating member 6 is rotated in the same direction as the type-carrying drum 8 through the spur gear 3 which is meshing with the spur gear 11. As the operating member 6 rotates in the manner described above, the operating member 6 moves leftward as seen in FIG. 1 a distance corresponding to the width of one of the cylinders A of the type-carrying drum 8 by virtue the configuration of the cam groove 4 in the cam portion 5 in which the pin 13 is loosely received. At this time, since all the type elements arranged in spirals on the cyliners A of the drum 8 pass by their associated hammer levers 9 once, if the electromagnet (not shown) positioned opposite each of the hammer levers 9 is energized while each of the type elements in the in spirals passes by the respectively associated hammer lever 9, as each hammer lever 9 rotates about the axis of the associated shaft (not shown), the hammer lever cooperates with its then associated type to effect a desired or necessary typewriting operation. Thus, as the type-carrying drum 8 moves leftward as seen in FIG. 1 by the distance corresponding to one cylinder A, 4*n* hammer levers 9 are actuated to complete a line of typewriting.

Thereafter, as the type-writing drum 8 makes two complete rotations, the type-carrying drum 8 moves in the opposite direction or rightward as seen in FIG. 1 a distance corresponding to one cylinder A to the intitial position while rotating in the direction of the arrow by being guided by the section *b* – *c* of the cam groove 4. As the type-carrying drum 8 moves rightward as seen in FIG. 1 as described above, the typewriting paper 14 is intermittently fed in the path between the drum 8 and hammer levers 9.

As is clear from the foregoing description in connection with one preferred embodiment of the invention, since a series of type elements are carried in a plurality of spiral rows on each of the cylinders of the type-carrying drum (in the illustrated embodiment, type elements are arranged in four spirals on each of the cylinders A of the type-carrying drum 8), the diameter of the drum can be reduced to one fourth that of the conventional type-carrying drum which carries type elements in lines on the periphery of the drum at right angles to the axis of the drum and thus, the overall size of the typewriting device can be reduced. The reduced size of the typewriting device in turn reduces the power required to drive the device as well as the moment of inertia resulting in minimization of vibration in the device.

In the foregoing description there has been described one preferred embodiment of the invention, but it will readily occur to those skilled in the art that the same is illustrative in nature, and does not limit the scope of the invention is any way. The scope of the invention is only limited by the appended claims.

What is claimed is:

1. A printing device comprising: a shaft rotatably mounted in a fixed position; a type-carrying drum mounted on the shaft for rotational movement around the axis of the shaft and for movement along the length of the shaft, said drum having a plurality of sections each having the same dimension in the direction of the length of the shaft and each of which sections has on the periphery thereof a group of type elements and said type elements being in a plurality of adjacent equally spaced spiral rows on said periphery; means for intermittently feeding a printing paper on a path tangent to said drum; a plurality of hammer members, one for each spiral row, lying on a line parallel to the axis of said shaft and opposite the point of tangency of said path, the spacing of said hammers along said line being the same as the pitch of the spiral rows of type elements on the drum, each of said hammer members being individually movable toward and away from said drum; a drive mechanism coupled to said drum for driving said drum along the length of said shaft in one direction a distance equal to the corresponding dimension of one drum section and returning the drum to an initial position, and rotatably driving the drum around the axis of the shaft in one direction a number of rotations equal to the number of spiral rows in a drum section for each movement of said drum along said shaft in said one direction, whereby the type elements of one group pass by the associated hammers; and a hammer operating means coupled to said hammers for moving said hammers toward said drum for striking a printing paper against the desired type element as they move past said hammers, said paper feeding device intermittently feeding said paper for each cycle of movement of said drum along said shaft.

2. A printing device as set forth in claim 1, in which each of said sections has the group of type elements arranged in four equally spaced spirals.

3. A printing device as set forth in claim 1, in which each of said sections has type elements bearing different symbols arranged in spirals.

4. A printing device as set forth in claim 1, in which said sections each have the same number of type elements bearing different symbols arranged in a plurality of spirals.

5. A printing device as set forth in claim 1, in which each of said sections has the same number of type elements in the group of type elements thereon, and said type elements on each section are arranged in four equally spaced spirals, the type elements in each group being the same as the type elements in the other groups.

* * * * *